US005210925A

United States Patent [19]

Morgulis

[11] Patent Number: 5,210,925

[45] Date of Patent: May 18, 1993

[54] PROCESS FOR MANUFACTURING A KNIFE

[75] Inventor: Mark Morgulis, San Diego, Calif.

[73] Assignee: Buck Knives, Inc., El Cajon, Calif.

[21] Appl. No.: 841,972

[22] Filed: Feb. 21, 1992

[51] Int. Cl.[5] ..... B22D 11/126

[52] U.S. Cl. ..... 29/527.4; 30/329; 30/340

[58] Field of Search ..... 29/527.4, 527.3; 30/329, 340

[56] References Cited

U.S. PATENT DOCUMENTS 4,955,139 9/1990 Clotten et al. ..... 30/340

FOREIGN PATENT DOCUMENTS 117751 11/1943 Australia ..... 30/340
1573403 8/1980 United Kingdom .
2221640 2/1990 United Kingdom .

*Primary Examiner*—Carl J. Arbes
*Attorney, Agent, or Firm*—Gregory Garmong

[57] ABSTRACT

A knife is fabricated by first preparing a steel knife blade with an integrally attached steel tang, usually by forging. Aluminum is die cast over the tang to form a quillen, a butt, and a handle base intermediate the quillen and the butt. A polymeric handle is injection molded over the handle base.

20 Claims, 2 Drawing Sheets

PROCESS FOR MANUFACTURING A KNIFE

BACKGROUND OF THE INVENTION

This invention relates to knives, and, more particularly, to a manufacturing method for fixed blade knives.

Knives are widely used and available in a variety of forms to suit particular requirements. A fixed blade knife (distinguished from a folding knife or pocket knife) has a blade and handle, and usually a quillen separating the blade from the handle. A popular type of fixed blade knife has a steel blade that holds an edge, a polymeric handle, an aluminum quillen, and an aluminum butt.

This type of fixed blade knife is made by forging a steel blade with an integrally attached tang. The tang is an extension of the blade portion that extends into the interior of the handle and provides strength as well as the means of attachment of the handle to the blade. A number of aluminum pieces are assembled to the tang, and polymeric handle pieces are assembled over the aluminum pieces and the steel tang. Fasteners hold the aluminum and polymeric pieces in place. A number of manufacturers use this approach for manufacturing such a fixed blade knife.

There is always a desire to improve the reliability and strength of such a product, and to reduce its manufacturing cost. The present invention fulfills this need, and further provides related advantages.

SUMMARY OF THE INVENTION

The present invention provides a manufacturing method for fixed blade knives. A fixed-blade knife, having an external appearance and functionality comparable with that of conventionally made fixed-blade knives, is less expensive to produce than a similar knife made by the conventional approach. The knife of the invention is also more reliable and resistant to damage.

In accordance with the invention, a process of manufacturing a knife comprises the steps of providing a knife blade with an attached tang, casting metal onto at least a portion of the tang, and molding a nonmetallic material overlying at least a portion of the tang.

In a preferred approach, the knife blade and tang are made of steel, and are forged as an integral unit. The metal cast onto a portion of the tang is aluminum that is cast by die casting. Typically, a quillen, a butt, and an intermediate handle base are cast over the tang. The nonmetallic material is a polymer that is injection molded over the metal handle base to form the handle.

The approach of the invention avoids the need to make numerous parts and then to assemble the parts together with fasteners. With the conventional approach, as many as nine separate parts are needed, each of which must be manufactured to good tolerances. The separate parts are assembled by hand labor to fabricate the knife. With the present approach, only a single part, the knife blade/tang unit, is prepared. Aluminum is die cast over the tang to form the remaining metallic parts of the knife. A polymeric material is thereafter injection molded to form the handle. No separate aluminum or polymeric parts are required, and no assembly is required. This reduces the cost of the final fixed blade knife. Additionally, the performance and reliability of the knife is improved, because there is much less likelihood, as compared with conventionally manufactured flat blade knives, that parts of the knife assembly can fail or become loose.

The approach of the invention provides an advance in the art of knife manufacture by reducing the cost and improving the performance of fixed blade knives. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENT

Figure 1:
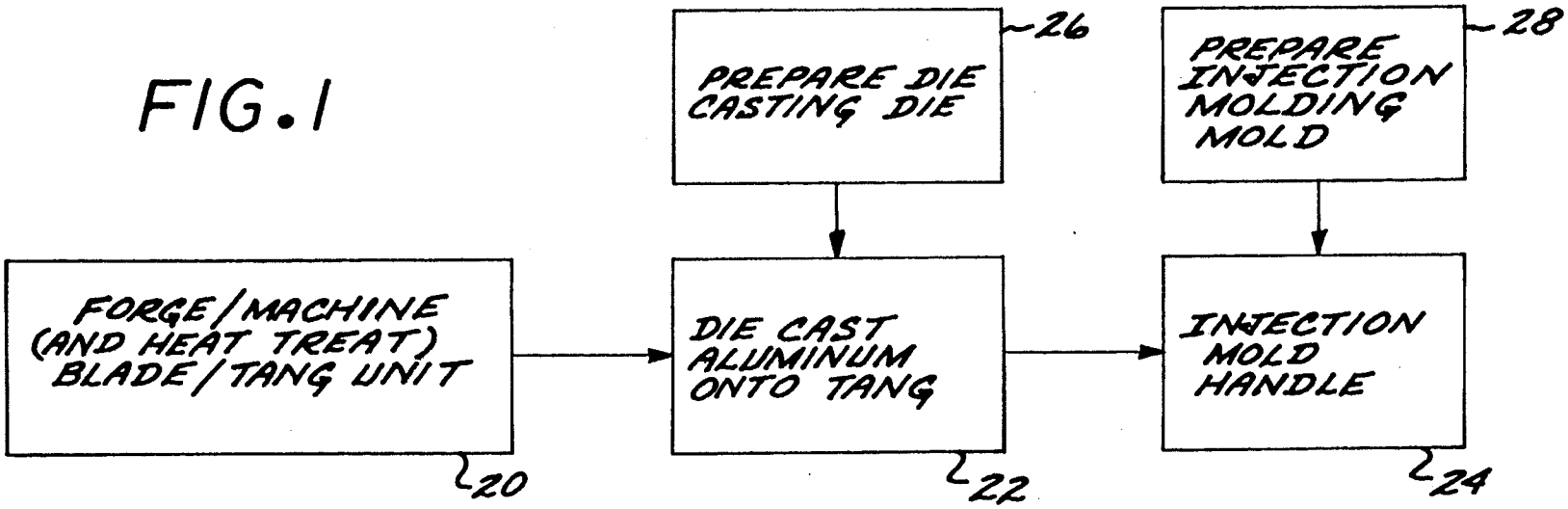
FIG. 1 is a flow chart for the preferred manufacturing process of the invention.
Figure 2:
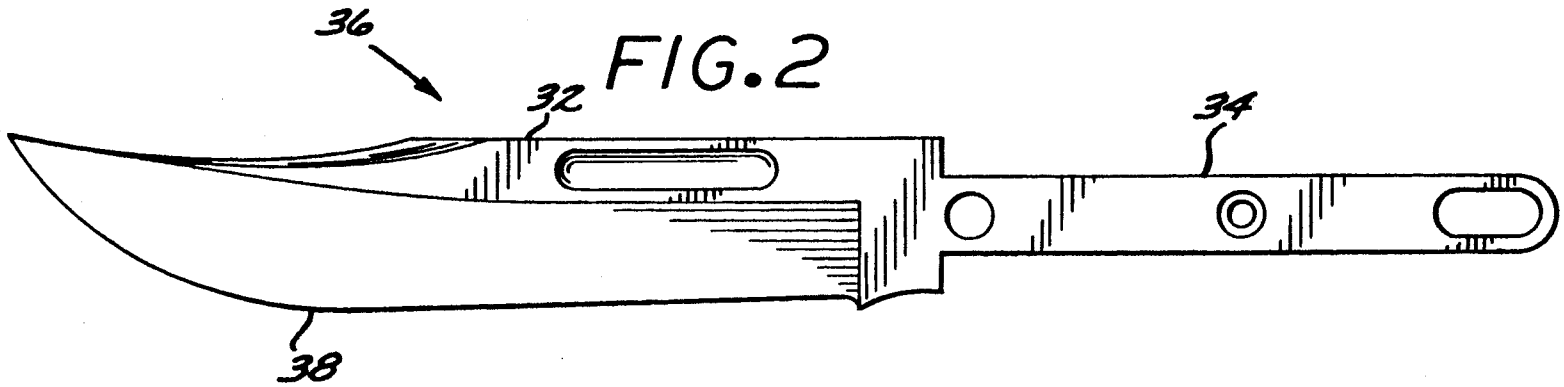
FIG. 2 is a side elevational view of a blade/tang forging.
Figure 3:
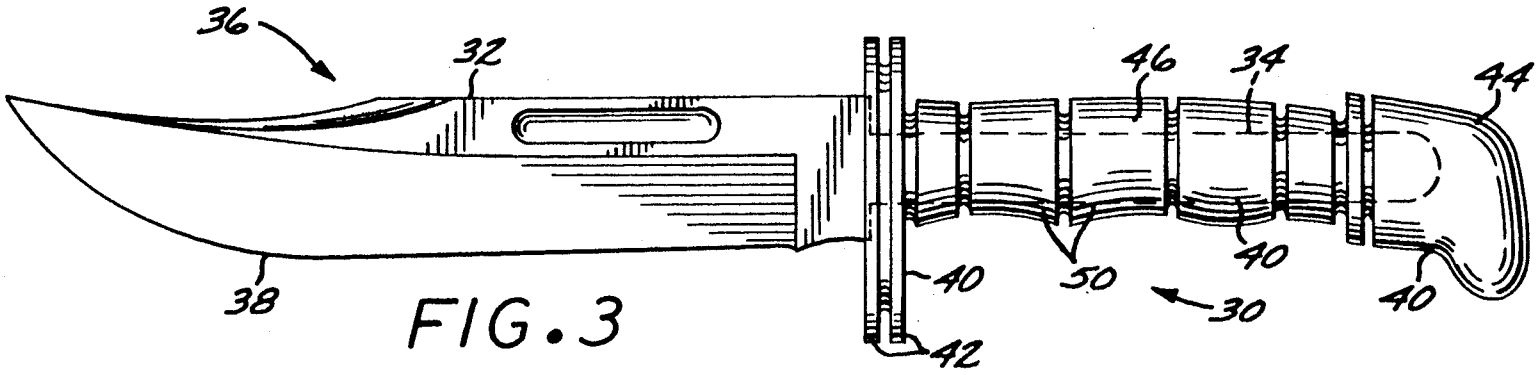
FIG. 3 is a side elevational view of the blade/tang forging, with aluminum die cast over the tang.
Figure 4:
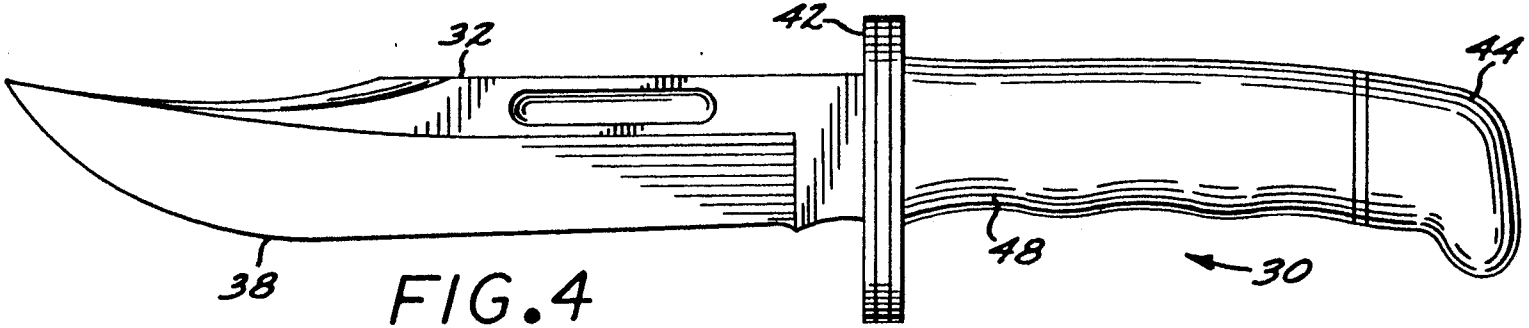
FIG. 4 is a side elevational view of the blade, tang, and aluminum portions of the knife, with polymeric material injection molded to form the handle.
Figure 5:
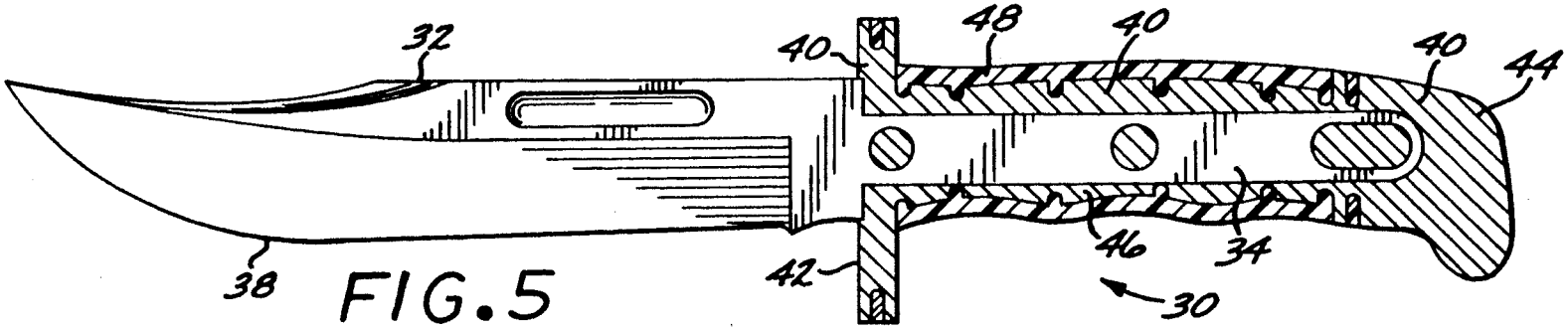
FIG. 5 is a partial sectional view of the knife of FIG. 4.

In accordance with a preferred embodiment of the invention, a process of manufacturing a fixed-blade knife includes the steps of providing a knife blade with an attached tang, placing the tang into a die casting mold, die casting metal into the die casting mold around the tang, placing the tang with die cast metal thereon into an injection molding mold, and injecting a polymeric material into the injection molding mold. FIG. 1 depicts the preferred process, FIGS. 2–4 depict the knife at successive stages of the production process, and FIG. 5 depicts the finished knife in section.

A fixed-blade knife 30 is manufactured by preparing a blade 32 with an attached tang 34, as indicated at numeral 20 of FIG. 1. The tang 34 is an extension of the blade 32 that is used to join the handle of the knife to the blade, in the manner to be discussed subsequently. The tang 34 is preferably formed integrally with the blade 32, by forging a blade/tang unit 36 to near-final shape and size, and then machining the unit. FIG. 2 depicts a typical configuration for such a blade/tang unit 36, after forging and machining.

The blade/tang unit 36 is preferably made of a steel such as 425 modified stainless steel. Such a steel is heat treatable, so that after forging and machining, the blade/tang unit 36 is heat treated in a manner known in the art. In a typical heat treatment, a cutting edge portion 38 of the blade 32 is made very hard so that it can be subsequently sharpened and will hold the edge. The remainder of the blade 32 and the tang 34 are provided a softer and more ductile, and therefore tougher, condition. For the case of 425 modified stainless steel, the cutting edge 38 is typically heat treated by quenching the unit 36 so that the cutting edge 38 has a hardness of about Rockwell C 58-59. The heat treatment portion of the manufacturing operation is optional, depending upon the choice of material of construction. The details of heat treatment, if used, will depend upon the material of construction of the blade/tang unit 36, and will be known to those skilled in the art for each such material.

In the past, it has been conventional practice at this point to furnish as separate pieces the remaining parts of the knife that make up the handle, quillen, and butt. The separate pieces were then assembled to the blade/tang unit with fasteners. The present approach provides an improved manufacturing procedure.

The remainder of the knife 30 is formed of at least two more materials, one a metal and the other a polymer such as a plastic. The preferred metal is aluminum. As used herein, "aluminum" includes both pure (e.g., 1100 aluminum) and alloyed aluminum. In this case, the preferred aluminum for use in the knife is the alloy 380-filtered, which can be die cast. The preferred polymer is a phenolic, a thermoset polymer which can be injection molded. In the manufacturing process, the aluminum is typically die cast, numeral 22 of FIG. 1, in place prior to the injection molding of the polymeric material, numeral 24, because die casting raises the part to a temperature higher than can be withstood by the polymeric material.

An aluminum structure 40 is cast, numeral 22, onto and overlying the tang 34 in a preselected shape suited for the particular configuration of knife 30 that is being manufactured. In the knife configuration of FIGS. 3-5, the aluminum structure 40 has three regions: a quillen 42, a knife handle butt 44, and an intermediate handle base 46 located between the quillen 42 and the butt 44.

The external configuration of the aluminum structure 40 and the three regions 42, 44, and 46 can be best seen in the intermediate manufacturing stage of FIG. 3 and in section in the final knife 30 in FIG. 5. The quillen 42 is the portion of the knife sometimes thought of as a hand guard that extends transversely to the blade 32 and the tang 34. The handle butt 44 is a metal piece at the end of the knife most remote from the cutting edge 38. The handle butt 44, together with the quillen 42, defines the extent of the handle and aids in preventing the user's hand from slipping off the handle. The handle butt 44 also provides a hard, durable surface as well as a bright metallic decoration. The handle base 46 lies between the quillen 42 and the handle butt 44. In a later stage, a polymer handle 48 is formed over the handle base 46, to be grasped in the hand of the user of the knife. To improve the adhesion of the polymer material to the knife, the handle base 46 is irregularly shaped, desirably with a plurality of segments 50.

The aluminum structure 40 is preferably die cast in place over the tang 34. Die casting generally is a well known procedure in the casting art, but has not heretofore been applied to preparing aluminum structures in situ on a knife. In die casting, a die defining the outer periphery of the casting is first prepared, numeral 26 of FIG. 1. The die need only be prepared once, and then it is used many times. The die is usually a split die that can be opened and closed. The die is designed so that the tang 34 (with its blade portion 32 typically extending outside the die) can be inserted into the die in the proper orientation and location so that there is a die cavity formed between the tang 34 and the walls of the die. The die is mounted in a die casting machine, which melts the metal to be die cast and then forces the proper amount of molten metal under pressure into the die cavity. The metal thereafter solidifies to form the aluminum structure 40. The die is opened so that the partially formed knife, at the stage shown in FIG. 3, can be removed from the die and another tang placed into the die. The die casting operation provides in one operation the various aluminum regions previously provided as separate solid parts and attached to the tang with fasteners. There may be small amounts of metallic flashing on the surface of the aluminum due to the presence of the split die, and this flashing is readily removed by grinding.

The polymeric knife handle 48 is formed over the metallic handle base 46, preferably by injection molding as indicated at numeral 24 of FIG. 1. Injection molding is a process conceptually similar to die casting, except that injection molding is performed with nonmetallic materials such as polymers and die casting is performed with metals. In injection molding, an injection molding mold defining the outer periphery of the polymeric handle 48 is first prepared, numeral 28 of FIG. 1. The mold is usually designed to provide the handle 48 with a shape that is comfortable in the hand of the user. In the knife of FIGS. 4 and 5, the handle 48 is smooth along the back of the knife and shaped as finger grips and rests along the opposite side.

The injection molding mold need only be prepared once, and then it is used many times. The mold is usually a split mold that can be opened and closed. The mold is designed so that the tang 34 (with its blade portion 32 typically extending outside the mold) and the previously die cast aluminum structure 40 can be inserted into the mold in the proper orientation and location so that there is a mold cavity formed between the tang 34 and the walls of the mold. The mold is mounted in an injection molding machine, which melts the polymeric material to be injection molded and then forces the proper amount of the polymeric material under pressure into the mold cavity. The polymeric material thereafter hardens to form the polymeric handle 48. The mold is opened so that the partially formed (but nearly complete) knife, at the stage shown in FIG. 4, can be removed from the mold and the process repeated to make another knife. The injection molding operation provides in one operation the polymeric handle previously provided as split halves and attached to the tang with fasteners.

The knife is essentially complete structurally. If there are any small amounts of polymeric flashing at the surface of the knife due to the split injection mold, they can be removed by grinding and/or polishing. Decoration and decorative finishes can be added, if desired.

The approach of the present invention provides both technical and economic advantages to the knife. Technically, the aluminum structure 40 adheres closely to the tang 34 along their entire facing surfaces. Similarly, the handle 48 adheres closely to the handle base 46 along their entire facing surfaces. No fasteners are needed. When a part is fastened to another with a discrete fastener through which the entire load is borne, the likelihood of failure under load is greater than when the load is distributed over a larger area. The present approach therefore achieves a lower loading per unit area of the gripping forces transmitted from the handle into the tang than in conventional designs wherein discrete fasteners are used. Moreover, there are no fasteners to loosen and separate from the knife handle. The aluminum structure 40 and the polymer handle 48 completely surround their supporting structure, and cannot fall off if a fastener were to loosen. (In some instances, fasteners may be used even with the present approach primarily for decoration and with little, if any, load bearing function.)

Economically, the present approach produces a technically superior knife at reduced cost. There is an initial cost for the dies and molds, but these costs are amortized over many thousands of knives that may be made with a single set of dies and molds. By contrast, in the prior approach wherein multiple small parts were used to form the metallic and polymeric structures, these small parts had to be prepared, possibly by die casting or injection molding, requiring preparation of multiple dies and molds. Moreover, there is an assembly cost associated with the assembly of a number of small parts to the blade/tang unit. Preliminary cost estimates indicate that the cost of manufacture is reduced by about 27 percent using the present approach rather than the prior approach.

The present invention thus provides an important advance in the art of manufacturing knives. Although a particular embodiment of the invention has been described in detail for purposes of illustration, various modifications may be made without departing from the spirit and scope of the invention. Accordingly, the invention is not to be limited except as by the appended claims.

What is claimed is:

1. A process of manufacturing a knife, comprising the steps of:

providing a knife blade with an attached tang;

casting metal onto at least a portion of the tang; and molding a nonmetallic material overlying at least a portion of the tang.

2. The process of claim 1, wherein the knife blade and attached tang are made of metal.

3. The process of claim 1, wherein the knife blade and attached tang are made of steel.

4. The process of claim 1, wherein the step of casting is accomplished by die casting.

5. The process of claim 1, wherein the step of casting includes the casting of a butt end of the knife onto the end of the tang remote from the blade.

6. The process of claim 1, wherein the step of casting includes the casting of a quillen at the location where the blade and the tang join.

7. The process of claim 1, wherein the step of casting includes the casting of a handle base over a portion of the length of the tang.

8. The process of claim 1, wherein the metal used in the step of casting is aluminum.

9. The process of claim 1, wherein the step of molding is accomplished by injection molding.

10. The process of claim 1, wherein the step of molding includes the molding of a handle over a portion of the length of the tang.

11. The process of claim 1, wherein the nonmetallic material used in the step of molding is a polymeric material.

12. A process of manufacturing a knife, comprising the steps of:

forging a steel knife blade with an integrally attached steel tang;

die casting aluminum over the tang to form a quillen, a butt, and a handle base intermediate the quillen and the butt; and injection molding a polymeric handle over the handle base.

13. A process of manufacturing a knife, comprising the steps of:

providing a knife blade with an attached tang;

placing the tang into a die casting mold;

die casting metal into the die casting mold around the tang;

placing the tang with die cast metal thereon into an injection molding mold; and injecting a hardenable polymer into the injection molding mold.

14. The process of claim 13, wherein the knife blade and attached tang are made of metal.

15. The process of claim 13, wherein the knife blade and attached tang are made of steel.

16. The process of claim 13, wherein the step of providing is accomplished by forging the knife blade and attached tang.

17. The process of claim 13, wherein the die casting mold defines a butt end of the knife at the end of the tang remote from the blade.

18. The process of claim 13, wherein the die casting mold defines a quillen at the location where the blade and the tang join.

19. The process of claim 13, wherein the die casting mold defines a handle base over a portion of the length of the tang.

20. The process of claim 13, wherein the injection molding mold defines a handle over a portion of the length of the tang.

* * * * *